US010089930B2

(12) United States Patent
Liu et al.

(10) Patent No.: US 10,089,930 B2
(45) Date of Patent: Oct. 2, 2018

(54) BRIGHTNESS COMPENSATION IN A DISPLAY

(71) Applicant: University of Florida Research Foundation, Inc., Gainesville, FL (US)

(72) Inventors: Bo Liu, Gainesville, FL (US); Andrew Gabriel Rinzler, Newberry, FL (US); Mitchell Austin McCarthy, Gainesville, FL (US)

(73) Assignee: University of Florida Research Foundation, Incorporated, Gainesville, FL (US)

( * ) Notice: Subject to any disclaimer, the term of this patent is extended or adjusted under 35 U.S.C. 154(b) by 0 days.

(21) Appl. No.: 14/440,513

(22) PCT Filed: Nov. 5, 2013

(86) PCT No.: PCT/US2013/068402
§ 371 (c)(1),
(2) Date: May 4, 2015

(87) PCT Pub. No.: WO2014/071343
PCT Pub. Date: May 8, 2014

(65) Prior Publication Data

US 2015/0269887 A1 Sep. 24, 2015

Related U.S. Application Data

(60) Provisional application No. 61/722,496, filed on Nov. 5, 2012.

(51) Int. Cl.
*G09G 3/3258* (2016.01)
*G09G 3/3225* (2016.01)
(Continued)

(52) U.S. Cl.
CPC ..... *G09G 3/3258* (2013.01); *G09G 3/325* (2013.01); *G09G 3/3208* (2013.01);
(Continued)

(58) Field of Classification Search
CPC ... G09G 2300/0819; G09G 2320/0209; G09G 2320/0223; G09G 2320/0233;
(Continued)

(56) References Cited

U.S. PATENT DOCUMENTS 3,700,979 A 10/1972 Saxena
3,841,904 A 10/1974 Chiang
(Continued)

FOREIGN PATENT DOCUMENTS

AU 2011222601 7/2013
CA 2702851 A1 3/2009
(Continued)

OTHER PUBLICATIONS

U.S. Appl. No. 14/648,608, filed May 29, 2015, Rinzler et al.
(Continued)

*Primary Examiner* — Tony Davis
(74) *Attorney, Agent, or Firm* — Wolf, Greenfield & Sacks, P.C.

(57) ABSTRACT

Various examples are provided for brightness compensation in a display. In one example, a method includes identifying an IR voltage drop effect on a pixel supplied by a supply voltage line and generating a brightness signal for the pixel based at least in part on the IR voltage drop effect. In another example, a method includes calculating values of IR voltage drop corresponding to pixels fed by a common supply voltage line and providing a data line signal to each pixel that compensates for the IR voltage drop. In another example, a display device includes a matrix of pixels and a brightness controller configured to determine an IR voltage
(Continued)

drop effect on a pixel of the matrix and generate a brightness signal for the pixel based at least in part on the IR voltage drop effect and a temporal average pixel brightness within one refreshing cycle associated with the pixel.

21 Claims, 4 Drawing Sheets

(51) Int. Cl.

| | |
|---|---|
| ***G09G 3/3275*** | (2016.01) |
| ***G09G 3/3208*** | (2016.01) |
| ***G09G 3/3233*** | (2016.01) |
| ***G09G 3/325*** | (2016.01) |
| ***G09G 3/3283*** | (2016.01) |
| ***G09G 3/3291*** | (2016.01) |

(52) U.S. Cl.
CPC ..... *G09G 3/3225* (2013.01); *G09G 3/3233* (2013.01); *G09G 3/3275* (2013.01); *G09G 3/3283* (2013.01); *G09G 3/3291* (2013.01); *G09G 2300/0819* (2013.01); *G09G 2320/0209* (2013.01); *G09G 2320/0223* (2013.01); *G09G 2320/0233* (2013.01)

(58) Field of Classification Search
CPC .. G09G 3/3208; G09G 3/3225; G09G 3/3233; G09G 3/325; G09G 3/3258; G09G 3/3275; G09G 3/3283; G09G 3/3291
USPC ..... 345/78, 82, 211
See application file for complete search history.

(56) References Cited

U.S. PATENT DOCUMENTS 4,471,367 A 9/1984 Chen et al.
5,210,045 A 5/1993 Possin et al.
5,429,968 A 7/1995 Koyama
5,793,055 A 8/1998 Kastalsky
6,480,412 B1 11/2002 Bessho et al.
6,492,669 B2 12/2002 Nakayama et al.
6,744,111 B1 6/2004 Wu
6,800,499 B2 10/2004 Chen et al.
7,060,241 B2 6/2006 Glatkowski
7,068,452 B2 6/2006 Ogawa et al.
7,098,151 B2 8/2006 Moriya et al.
7,102,157 B2 9/2006 Kastalsky et al.
7,115,916 B2 10/2006 Avouris et al.
7,119,402 B2 10/2006 Kinoshita et al.
7,247,913 B2 7/2007 Yagishita
7,259,984 B2 8/2007 Kan et al.
7,323,730 B2 1/2008 Borghetti et al.
7,359,888 B2 4/2008 Snider
7,378,328 B2 5/2008 Choi et al.
7,405,129 B2 7/2008 Afzali-Ardakani et al.
7,439,562 B2 10/2008 Auvray et al.
7,473,922 B2 1/2009 Uchiyama et al.
7,538,337 B2 5/2009 Hijzen et al.
7,545,051 B2 6/2009 Yang et al.
7,545,241 B2 6/2009 Wakabayashi et al.
7,645,933 B2 1/2010 Narkis et al.
8,022,432 B2 9/2011 Yi et al.
8,058,167 B2 11/2011 Snyder et al.
8,217,386 B2 7/2012 Rinzler et al.
8,232,561 B2 7/2012 Rinzler et al.
8,564,048 B2 10/2013 Rinzler et al.
8,587,513 B2 * 11/2013 Ozawa ..... G09G 3/344 345/107
8,952,361 B2 2/2015 Rinzler et al.
9,214,644 B2 12/2015 Rinzler et al.
2002/0070382 A1 6/2002 Yamazaki
2002/0173083 A1 11/2002 Avouris et al.
2002/0195644 A1 12/2002 Dodabalapur et al.
2004/0113152 A1 6/2004 Kim et al.
2004/0183758 A1 * 9/2004 Chen ..... G09G 3/3233 345/76
2004/0197546 A1 10/2004 Rinzler et al.
2005/0001299 A1 1/2005 Forbes
2005/0121674 A1 6/2005 Kamata et al.
2005/0140600 A1 * 6/2005 Kim ..... G09G 3/3233 345/76
2005/0146264 A1 * 7/2005 Kwak ..... H01L 27/3279 313/504
2005/0206300 A1 9/2005 Perlo et al.
2005/0245087 A1 11/2005 Sasagawa et al.
2006/0023511 A1 2/2006 Wang et al.
2006/0065887 A1 3/2006 Tiano et al.
2006/0081882 A1 4/2006 Malenfant et al.
2006/0102067 A1 5/2006 Noguchi et al.
2006/0145144 A1 7/2006 Lee et al.
2006/0243971 A1 11/2006 Iechi et al.
2006/0244391 A1 11/2006 Shishido et al.
2006/0263255 A1 11/2006 Han et al.
2006/0284230 A1 12/2006 Yang et al.
2006/0292362 A1 12/2006 Hsu et al.
2007/0012922 A1 1/2007 Harada et al.
2007/0035486 A1 2/2007 Kasai
2007/0138462 A1 6/2007 Street et al.
2007/0146247 A1 * 6/2007 Huang ..... G09G 3/3233 345/76
2007/0146252 A1 6/2007 Miller et al.
2007/0147159 A1 6/2007 Lee
2007/0215954 A1 9/2007 Mouli
2008/0100542 A1 * 5/2008 Miller ..... G09G 3/3258 345/77
2008/0143389 A1 6/2008 Keshavarzi et al.
2008/0150846 A1 * 6/2008 Chung ..... G09G 3/3233 345/80
2008/0169822 A1 * 7/2008 Kwak ..... G09G 3/006 324/537
2008/0252203 A1 * 10/2008 Lee ..... H01L 27/3276 313/504
2008/0272381 A1 11/2008 Noguchi et al.
2009/0008634 A1 1/2009 Tessler et al.
2009/0072229 A1 * 3/2009 Suh ..... H01L 27/3276 257/40
2009/0085182 A1 4/2009 Yamazaki
2009/0125858 A1 * 5/2009 Vishweshwara .... G06F 17/5031 716/113
2009/0134387 A1 5/2009 Harada
2009/0159971 A1 6/2009 Street et al.
2009/0184903 A1 * 7/2009 Kwon ..... G09G 3/3225 345/80
2009/0206341 A1 8/2009 Marks
2009/0230384 A1 9/2009 Meng et al.
2009/0256140 A1 * 10/2009 Meng ..... G01N 21/6428 257/40
2009/0302310 A1 12/2009 Rinzler et al.
2009/0302749 A1 * 12/2009 Lee ..... B82Y 10/00 313/504
2009/0315025 A1 12/2009 Kitamura
2010/0042345 A1 * 2/2010 Kang ..... G01R 31/3662 702/65
2010/0053137 A1 3/2010 Park et al.
2010/0065826 A1 3/2010 Takimya et al.
2010/0085009 A1 * 4/2010 Kang ..... H01M 10/482 320/118
2010/0123120 A1 5/2010 Mohseni
2010/0126885 A1 5/2010 Iechi et al.
2010/0127243 A1 5/2010 Banerjee et al.
2010/0148183 A1 6/2010 Ward et al.
2010/0155696 A1 6/2010 Duan et al.
2010/0171419 A1 * 7/2010 Kim ..... H01L 51/5228 313/505
2010/0177024 A1 * 7/2010 Choi ..... G09G 3/3233 345/76
2010/0237336 A1 9/2010 Rinzler et al.
2010/0277513 A1 * 11/2010 Byun ..... G09G 3/3233 345/690
2010/0309233 A1 12/2010 Choi
2011/0018787 A1 1/2011 Nakamura et al.

(56) References Cited

U.S. PATENT DOCUMENTS

2011/0050659 A1* 3/2011 Tsai ..... G09G 3/3233 345/205
2011/0050736 A1* 3/2011 Fan ..... G09G 3/3233 345/690
2011/0063197 A1* 3/2011 Chung ..... G09G 3/3233 345/82
2011/0115764 A1* 5/2011 Chung ..... G09G 3/3233 345/205
2011/0115772 A1* 5/2011 Chung ..... G09G 3/3233 345/211
2011/0121271 A1 5/2011 Jeon et al.
2011/0128268 A1* 6/2011 Kim ..... G09G 3/3225 345/211
2011/0130981 A1 6/2011 Chaji et al.
2011/0153303 A1* 6/2011 Lo ..... G06F 17/5036 703/14
2011/0164071 A1* 7/2011 Chung ..... G09G 3/3208 345/690
2011/0169798 A1* 7/2011 Lee ..... G09G 3/3233 345/211
2011/0191042 A1 8/2011 Chaji et al.
2011/0234644 A1* 9/2011 Park ..... G09G 3/2003 345/690
2011/0248243 A1 10/2011 Chen et al.
2011/0248269 A1* 10/2011 Oh ..... B82Y 10/00 257/59
2011/0291115 A1* 12/2011 Kim ..... G09G 3/3225 257/88
2012/0012919 A1 1/2012 Kan et al.
2012/0013597 A1* 1/2012 Han ..... G09G 3/3233 345/212
2012/0044269 A1 2/2012 Cha et al.
2012/0050344 A1* 3/2012 Kim ..... G09G 3/3233 345/690
2012/0062613 A1* 3/2012 Park ..... G09G 3/3233 345/690
2012/0086694 A1* 4/2012 Tseng ..... G09G 3/3233 345/212
2012/0101022 A1 4/2012 Tovar
2012/0143568 A1 6/2012 Kagan et al.
2012/0168778 A1* 7/2012 Kim ..... H01L 27/3279 257/88
2012/0242712 A1* 9/2012 Ko ..... G09G 3/3233 345/690
2012/0249514 A1 10/2012 Ahn et al.
2012/0256175 A1 10/2012 Rinzler et al.
2012/0287103 A1* 11/2012 Wu ..... G09G 3/3233 345/211
2012/0293482 A1* 11/2012 Wu ..... G09G 3/3233 345/212
2012/0319096 A1 12/2012 Rinzler et al.
2013/0020967 A1* 1/2013 Jung ..... H01L 51/5243 315/312
2013/0063040 A1* 3/2013 Huang ..... G09G 3/3225 315/232
2013/0069852 A1* 3/2013 Liao ..... G09G 3/3233 345/77
2013/0088165 A1* 4/2013 Wang ..... G09G 3/3233 315/240
2013/0088417 A1* 4/2013 Kim ..... G09G 3/3233 345/82
2013/0088474 A1* 4/2013 Wang ..... G09G 3/3258 345/211
2013/0093800 A1* 4/2013 Shim ..... G09G 3/3233 345/690
2013/0120342 A1* 5/2013 Wang ..... G09G 3/30 345/211
2013/0240842 A1* 9/2013 Rinzler ..... H01L 51/057 257/40
2013/0258782 A1 10/2013 Tatsumura et al.
2013/0293450 A1* 11/2013 Wu ..... G09G 3/02 345/82
2014/0181771 A1* 6/2014 Sajid ..... G06F 17/5036 716/113
2014/0351781 A1* 11/2014 Rozen ..... G06F 17/5072 716/120
2015/0340631 A1 11/2015 Rinzler et al.

FOREIGN PATENT DOCUMENTS

CN 1324550 A 11/2001
CN 1501341 A 6/2004
CN 1581512 A 2/2005
CN 1698217 A 11/2005
CN 1797723 A 7/2006
CN 1816913 A 8/2006
CN 1875496 A 12/2006
CN 1912977 A 2/2007
CN 101276638 A 10/2008
CN 101375426 A 2/2009
CN 101379881 A 3/2009
CN 101855938 A 10/2010
CN 102725786 A 10/2012
CN 103460424 A 12/2013
EP 1 718 126 A1 11/2006
EP 08799410.9 10/2012
EP 11751409.1 4/2014
EP 11846649.9 11/2014
EP 13850837.9 5/2016
EP 13857789.5 9/2016
JP S55-32235 B1 8/1980
JP 2003-108034 A 4/2003
JP 2003-258265 A 9/2003
JP 2003-330412 A 11/2003
JP 2003-332350 A 11/2003
JP 2005-064452 A 3/2005
JP 2005-128310 A 5/2005
JP 2005-228804 A 8/2005
JP 2005-268550 A 9/2005
JP 2005-535139 A 11/2005
JP 2006-171745 A 6/2006
JP 2006-210910 A 8/2006
JP 2006-301629 A 11/2006
JP 2007-047634 A 2/2007
JP 2007-109454 A 4/2007
JP 2007-200788 A 8/2007
JP 2009-513022 A 3/2009
JP 2009-130165 A 6/2009
JP 2009-521719 A 6/2009
JP 2009-522802 A 6/2009
JP 2009-530820 A 8/2009
JP 2010-003831 A 1/2010
JP 2010-062549 A 3/2010
JP 2010-151540 A 7/2010
JP 2011-027819 A 2/2011
JP 2011-095506 A 5/2011
JP 2013-521664 A 6/2013
JP 2014-505324 A 2/2014
KR 10-2001-0075311 A 8/2001
KR 10-2005-0098333 A 10/2005
KR 10-068001 B1 2/2007
KR 10-2007-0038547 A 4/2007
KR 10-2010-0086464 A 7/2010
KR 10-2012-0111675 10/2012
WO WO 01/008192 A1 2/2001
WO WO 2005/024907 A2 3/2005
WO WO 2005/091373 A1 9/2005
WO WO 2007/048041 A2 4/2007
WO WO 07/080575 A1 7/2007
WO WO 2007/075517 7/2007
WO PCT/US2007/072501 4/2008
WO WO 2008-050726 A1 5/2008
WO WO 2009/036071 A2 3/2009
WO PCT/US2008/075866 5/2009
WO WO 2011/064761 A1 6/2011
WO WO 2011/109693 A2 9/2011
WO PCT/US2011/027155 10/2011
WO WO 2012/078759 A2 6/2012

(56) References Cited

FOREIGN PATENT DOCUMENTS

WO PCT/US2011/063745 7/2012
WO PCT/US2013/071919 3/2014

OTHER PUBLICATIONS

Xu et al., Vertical organic light emitting transistor. Applied Physics Letters. 2007;91(9). 3 pages.
International Search Report dated Feb. 27, 2014 in connection with Application No. PCT/US2013/068402.
Japanese Communication and Translation thereof for Japanese Application No. 2015-540854 dated Aug. 1, 2017.
Patent Examination Report dated Jul. 30, 2013 for Application No. AU 2011222601.
Extended European Search Report dated Apr. 11, 2014 for Application No. EP 11751409.1.
International Search Report and Written Opinion dated Oct. 27, 2011 for Application No. PCT/US2011/027155.
Extended European Search Report dated Nov. 27, 2014 for Application No. EP 11846649.9.
International Search Report and Written Opinion dated Jul. 18, 2012 for Application No. PCT/US2011/063745.
Extended European Search Report dated Oct. 26, 2012 for Application No. EP 08799410.9.
International Search Report and Written Opinion dated May 8, 2009 for Application No. PCT/US2008/075866.
International Search Report and Written Opinion dated Apr. 29, 2008 for Application No. PCT/US2007/072501.
Extended European Search Report dated Sep. 12, 2016 for Application No. EP 13857789.5.
International Search Report and Written Opinion dated Mar. 19, 2014 for Application No. PCT/US2013/071919.
Extended European Search Report dated May 9, 2016 for Application No. EP 13850837.9.
Aguirre et al., Carbon Nanotubes as Injection Electrodes for Organic Thin Film Transistors. Nano Lett. 2009;9(4):1457-61.
Al-Ibrahim et al., The influence of the optoelectronic properties of poly (3-alkylthiophenes) on the device parameters in flexible polymer solar cells. Org Electron. 2005;(6):65-77.
Asadi et al., Manipulation of charge carrier injection into organic field-effect transistors by self-assembled monolayers of alkanethiols. J Mater Chem. 2007;(17):1947-53.
Baeg et al., Organic Non-Volatile Memory Based on Pentacene Field-Effect Transistors Using a Polymeric Gate Electret. Adv Mater. 2006;(18):3179-83.
Bo et al., Pentacene-carbon nanotubes: Semiconducting assemblies for thin-film transistor applications. Appl Phys Lett. 2005;87(20):203510. 1-3.
Cao et al., Highly bendable transparent thin-film transistors that use carbon-nanotube-based conductors and semiconductors with elastomeric dielectrics. Adv Mater. 2006;(18):304-9.
Cao et al., Transparent flexible organic thin-film transistors that use printed single-walled carbon nanotube electrodes. Appl Phys Lett. 2006;88(11):113511.1-3.
Di et al., Noncoplanar organic field-effect transistor based on copper phthalocyanine. Appl Phys Lett. 2006;88(12):121907.1-3.
Forsythe et al., Interface analysis of naphthyl-substituted benzidine derivative and tris-8-(hydroxyquinoline) aluminum using ultraviolet and x-ray photoemission spectroscopy. J Vacuum Sci Tech. 1999;17(6):3429-32.
Jou et al., Efficient pure-white organic light-emitting diodes with a solution-processed, binary-host employing single emission layer. Appl Phys Lett. 2006;(88):141101.1-3.
Katz, et al., Organic Field-Effect Transistors with Polarizable Gate Insulators. J Appl Phys. 2002;91(3):1572-6.
Lee et al., Single Wall Carbon Nanotubes for p-Type Ohmic Contacts to GaN Light-Emitting Diodes. Nano Lett. 2004;4(5):911-4.
Li et al., Achieving ambipolar vertical organic transistors via nanoscale interface modification. Appl Phys Lett. 2007;(91):083507. 1-3.
Liu et al., Carbone-Nanotube-Enabled Vertical Field Effect and Light-Emitting Transistors. Adv Mater. 2008;20:3605-9.
Lonergan et al., A Tunable Diode Based on an Inorganic Semiconductor | Conjugated Polymer Interface. Sci. 1997;278:2103-6.
Ma et al., Unique architecture and concept for high-performance organic transistors. Appl Phys Lett. 2004;85(21):5084-6.
Park et al., Recent Development in Polymer Ferroelectric Field Effect Transistor Memory. J Semiconductor Tech Sci. 2008;8(1):51-65.
Qi et al., Miniature Organic Transistors with Carbon Nanotubes as Quasi-One-Dimensional Electrodes. J Amer Chem Soc. 2004;126(38):11774-5.
Schroeder et al., All-Organic Permanent Memory Transistor Using an Amorphous, Spin-Cast Ferroelectric-like Gate Insulator. Adv Mater. 2004;16(7):633-6.
Scott et al., Nonvolatile Memory Elements Based on Organic Materials. Adv Mater. 2007;19(11):1452-63.
Unalan et al., Design Criteria for Transparent Single-Wall Carbon Nanotube Thin-Film Transistors. Nano Letters. 2006;6(4):677-82.
Velu et al., Low Driving Voltages and Memory Effect in Organic Thin-Film Transistors with a Ferroelectric Gate Insulator. Appl Phys Lett. 2001;79(5):659-61.
Wu et al., High-Performance Organic Transistor Memory Elements with Steep Flanks of Hysteresis. Adv Funct Mater. 2008;18:2593-601.
Wu et al., Transparent, Conductive Carbon Nanotube Films. Sci. 2004;(305):1273-6.

* cited by examiner

BRIGHTNESS COMPENSATION IN A DISPLAY

CROSS REFERENCE TO RELATED APPLICATIONS

This application is a U.S. National Stage application under 35 U.S.C. § 371 based on International Application No. PCT/US2013/068402, entitled "BRIGHTNESS COMPENSATION N A DISPLAY" filed Nov. 5, 2013, which claims priority to and the benefit of U.S. provisional application entitled "BRIGHTNESS COMPENSATION IN A DISPLAY" having Ser. No. 61/722,496, filed Nov. 5, 2012, each of which is hereby incorporated by reference herein in its entirety.

BACKGROUND

A display device, such as an Active Matrix Organic Light Emitting Diode (AMOLED) display, may include several pixels. The pixels may be periodically refreshed in order to display a stationary or dynamic picture.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Active matrix organic light emitting diode (AMOLED) displays have a wider viewing angle, are brighter, have faster response times, have a slimmer panel and consume less energy when compared with LCD displays. Each pixel in an AMOLED panel contains an organic light emitting diode (OLED) that lights up to form the display. Pixels are arranged in a matrix, where the refreshing of the screen is done in a row-by-row fashion. Each pixel in a row is refreshed simultaneously within a given time slot, after which the pixel is kept at the prescribed brightness level until the next refresh cycle, thus the name active matrix, in comparison with passive matrix where each pixel only maintain its brightness when it is addressed. For the display to function properly a pixel in an AMOLED display is set to the brightness level appropriate to the specific overall scene to be conveyed and that brightness level must be maintained ("memorized") until the next refresh resets the pixel for the next scene. To achieve that each pixel contains a circuit, called the pixel circuit, to drive its OLED. Pixel circuits are connected by bus lines that provide the signal and power to each circuit. The pixel circuits and bus lines form the backplane of the AMOLED.

Figure 1:
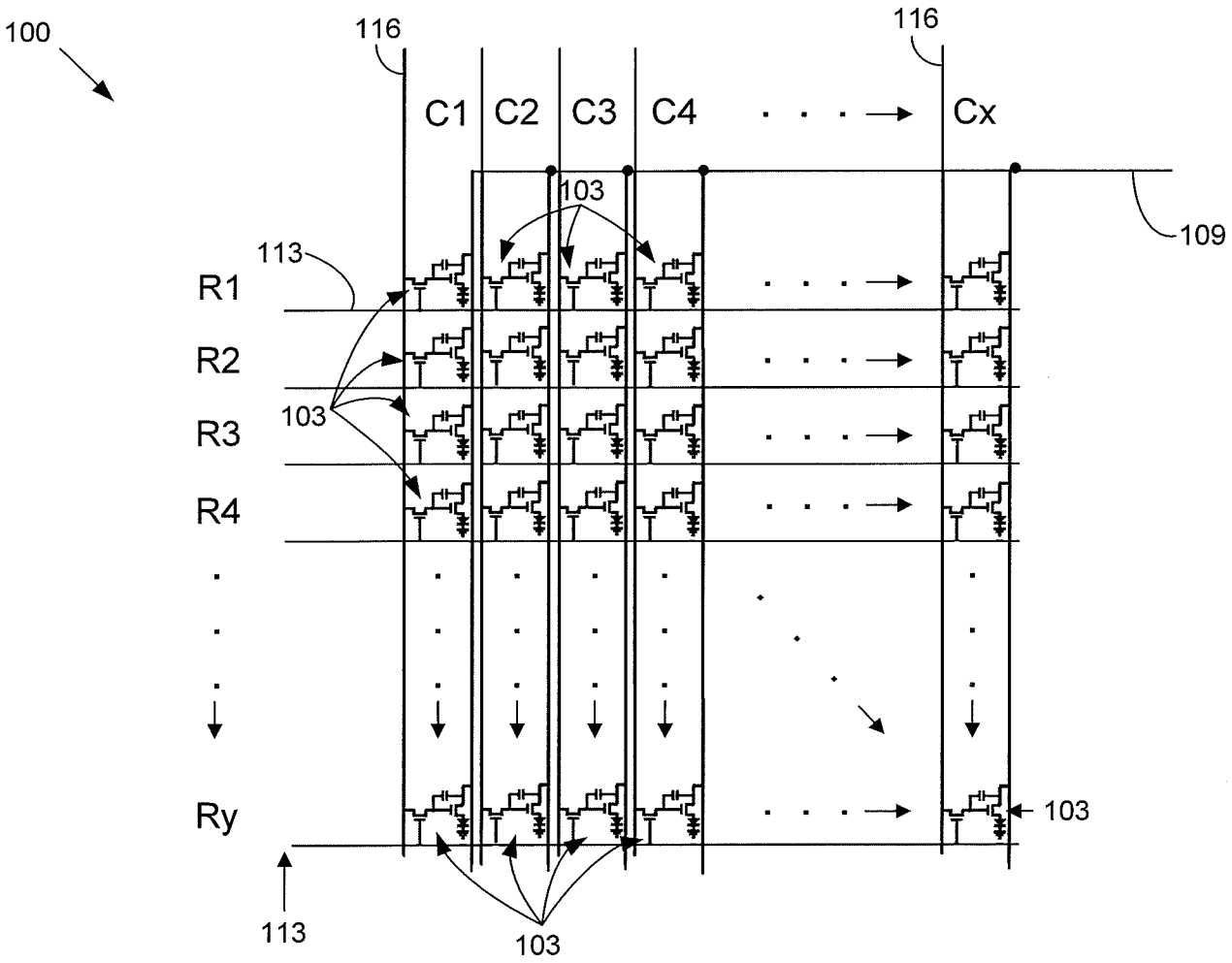
FIG. 1 is a circuit diagram of a portion of a display device according to various embodiments of the present disclosure.

With reference to FIG. 1, shown is a circuit diagram of a portion of a display device 100 according to an embodiment of the present disclosure. The display device 100 may comprise, for example, an active matrix organic light emitting diode (AMOLED) panel or any type of display device wherein the instantaneous pixel light output is dependent upon the current through the light emitting subcomponent within the pixel, the bus line supplying that current is shared with other pixels, and multiple pixels along that line are simultaneously lit. As shown in FIG. 1, the display device 100 includes a matrix of pixels 103 arranged in columns $C_1$-$C_x$ and rows $R_1$-$R_y$. The display device 100 also includes a supply voltage line 109 (also termed $V_{DD}$) that is coupled to pixels 103 in each of the columns $C_1$-$C_x$. Additionally, each row $R_1$-$R_y$ of pixels 103 includes a scan line 113, and each column of pixels 103 includes a data line 116.

All of the pixels 103 in a particular row $R_1$-$R_y$ of the display device 100 are refreshed simultaneously within a given timeslot, after which these pixels 103 are kept at the prescribed brightness level until the particular row $R_1$-$R_y$ is refreshed in the next refresh cycle. To this end, a brightness signal is applied to each data line 116, and one of the scan lines 113 is asserted. In response to the scan line 113 being asserted, the brightness signals applied to the data lines 116 are provided to the corresponding pixels 103 in the corresponding row $R_1$-$R_y$. Thereafter, new brightness signals are applied to the data lines 116, and the scan line 113 for the next row $R_1$-$R_y$ is asserted. In response, the pixels 103 for the new row $R_1$-$R_y$ having the asserted scan line 113 are provided with the brightness signals being applied to the data lines 116. This process is then repeated for all of the remaining rows $R_1$-$R_y$ of the display device 100 to thereby generate a picture. The process may be further repeated for all of the pixels 103 with varying signals on the data lines 116 to generate a dynamic picture.

Figure 2:
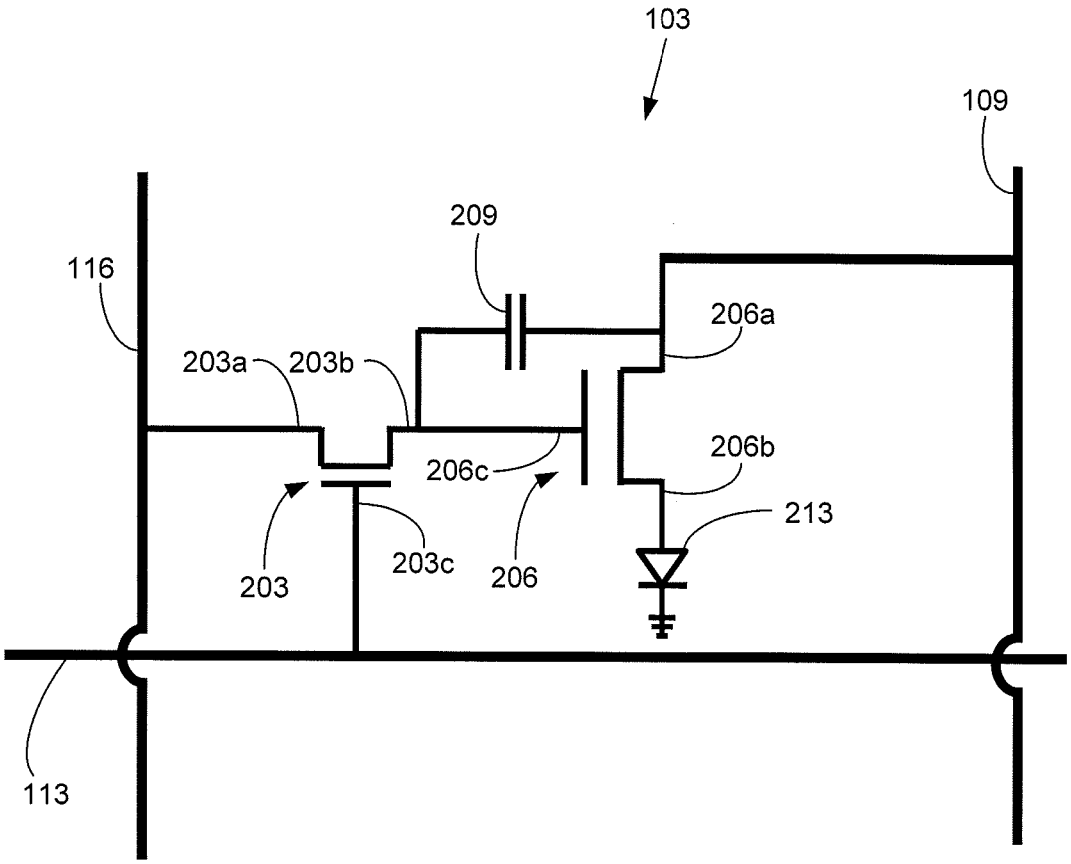
FIG. 2 is a circuit diagram of an example of a pixel in the display device of FIG. 1 according to various embodiments of the present disclosure.

Turning to FIG. 2, shown is a circuit diagram of an example of one of the pixels 103 in the display device 100 (FIG. 1) according to various embodiments of the present disclosure. As shown, the pixel 103 may include one of the data lines 116, the supply voltage line 109, and one of the scan lines 113. In addition, the pixel 103 may include a switching transistor 203, a driving transistor 206, a capacitor 209, a light emitting device 213, and potentially other components not discussed in detail for brevity. It is understood that other circuit configurations and components may be used for the pixel 103 in alternative embodiments.

The light emitting device 213 is configured to emit light in response to a current flowing through the light emitting device 213. As such, the light emitting device 213 may be embodied in the form of, for example, an organic light emitting diode (OLED), a inorganic light emitting diode (LED), a quantum dot based light emitting diode or any other type of light emitting device.

The driving transistor 206 is configured to provide and control the amount of current that flows through the light emitting device 213. To this end, a first terminal **206*a* of the driving transistor 206 is coupled to the supply voltage line 109, and a second terminal 206*b* for the driving transistor 206 is coupled to the light emitting device 213. As may be appreciated by a person having ordinary skill in the art, the amount of current that flows from the first terminal 206*a* to the second terminal 206*b* of the driving transistor 206 is dependent on the voltage level being applied to a third terminal 206*c* of the driving transistor 206. For instance, for the case in which the driving transistor 206 is a p-type MOS transistor operating in the saturation region, the current flowing through the driving transistor 206** may be modeled using the following equation:

$$I = \frac{1}{2}\mu C\frac{w}{L}(V_{DATA} - V_{DD} - V_{TH})^2 = \frac{1}{2}k(V_{DATA} - V_{DD} - V_{TH})^2, \quad \text{(EQN 1)}$$

where I is the current through the driving transistor 206, $V_{DATA}$ is the voltage of the brightness signal from the data line 116, $V_{DD}$ is the voltage on the supply voltage line 109, the threshold voltage $V_{TH}<0$ and $$k = \mu C\frac{W}{L}.$$

The areal capacitance of the gate dielectric is C, the mobility of the transistor is μ, and the transistor channel width to channel length ratio is $$\frac{W}{L}.$$

The switching transistor 203 is configured to selectively provide the third terminal 206*c* of the driving transistor 206 with a signal from the data line 116. To this end, a first terminal 203*a* of the switching transistor 203 is coupled to the data line 116, a second terminal 203*b* of the switching transistor 203 is coupled to the third terminal 206*c* of the driving transistor 206, and a third terminal 203*c* of the switching transistor 203 is coupled to the scan line 113. The switching transistor 203 may turn "on" or "off" in response to the signal being provided on the scan line 113. In this sense, the signal from the data line 116 passes through the switching transistor 203 to the third terminal 206*c* of the driving transistor 206 when the scan line 113 signal is asserted, causing the switching transistor 203 to be "on." When the scan line 113 is not asserted, the switching transistor 203 is "off," and the signal on the data line 116 is prevented from being received at the third terminal 206*c* of the driving transistor 206.

The capacitor 209 stores the voltage value (i.e., the brightness signal) that is provided to the third terminal 206*c* of the driving transistor 206 when the switching transistor 203 is "on" and substantially maintains this voltage value when the switching transistor 203 is "off." Because the capacitor 209 is coupled to the third terminal 206*c* of the driving transistor 206, the capacitor 209 helps to maintain a particular value of current flowing through the light emitting device 213 between refresh cycles for the display device 100.

During a pixel 103 refresh, a brightness signal is provided to the data line 116, and the scan line 113 is asserted to turn the switching transistor 203 "on" and thereby cause the brightness signal on the data line 116 to be provided to the third terminal 206*c* of the driving transistor 206. In response to the brightness signal being received at the third terminal 206*c* of the driving transistor 206, and in response to the particular value of the supply voltage at the first terminal 206*a* of the driving transistor 206, a current flows from the first terminal 206*a* to the second terminal 206*b* of the driving transistor 206 and through the light emitting device 213. This current relationship may be modeled, for example, by EQN 1. From the current flowing through the light emitting device 213, light is emitted from the light emitting device 213. Because the brightness of the light emitted from the light emitting device 213 is dependent upon the amount of current flowing from the driving transistor 206, the brightness of the light is also dependent upon the supply voltage value at the first terminal 206*a* and the brightness signal at the third terminal 206*c* of the driving transistor 206.

In the embodiment shown in FIG. 1, the supply voltage line 109 is coupled to the first terminal 206*a* of the driving transistor 206 for all of the pixels 103 in the display device 100. Because the supply voltage line 109 is a non-ideal conductor, the pixels 103 experience what may be referred to as an "IR drop". Since the resistance of the supply voltage line 109 is not zero, a voltage (V=IR) drop will be exhibited along the supply voltage line 109. This IR drop may affect brightness uniformity of the display device 100. As a consequence, the pixels 103 that are relatively far away from an input point for the supply voltage line 109 may, for example, receive lower supply voltages than the pixels 103 that are relatively close to the input point. For example, a simplified supply voltage model for a column of pixels 103 may be expressed as:

$$V_i = V_{DD0} - r\Sigma_{m=1}^{i} m \times I_m - r\Sigma_{m=i+1}^{n} i \times I_m, \quad \text{(EQN 2)}$$

where $V_i$ is the supply voltage seen by a particular pixel 103 from the supply voltage line 109 at location i, $V_{DD0}$ is the voltage of the supply voltage line 109 at the point of input for the display device 100, r is the resistance of a segment of the supply voltage line 109 between adjacent pixels 103, n is the number of pixels 103 in a column $C_1$-$C_y$ and $I_m$ is the current passing through the pixel m (from 1 to n). Thus, for each pixel 103, EQN 2 may be substituted for $V_{DD}$ in EQN 1 to account for IR drop.

Assuming that the current on pixel i changed by an amount of $\Delta I_i = I_{next\ frame} - I_{current\ frame}$, the supply voltage line 109 will need to carry this $\Delta I_i$ up to pixel i. Because the resistance of the line is a relatively small number, and the current change possibly made by one pixel will be small compared to the total current carried by the supply voltage line 109, higher order effects can be ignored and, under this assumption, the change of voltage seen by pixel i may be expressed as $\Delta V_i = -i \times r \times \Delta I_i$. Since the change in voltage for the pixel at location i is caused by the pixel at location i itself, $\Delta V_i$ can be rewritten as $\Delta V_{i,i}$ where the first index indicates the pixel for which the voltage has been affected, and the second index indicates the pixel at which current has changed that caused this voltage change. Considering the cross-talk with other pixels, a current change $\Delta I_i$ for the pixel at location i can result in a voltage change for the pixel at location j, which can be expressed as $\Delta V_{j,i} = -i \times r \times \Delta I_i$ for j>1.

The supply voltage line 109 may also facilitate unintentional cross-talk due to the refreshing of the pixels 103. For example, the change in the supply voltage for a first pixel 103 at location i due to a change in current for a second pixel 103 at location m, wherein the first pixel 103 and the second pixel 103 are in the same column $C_1$-$C_y$, may be expressed as:

$$\Delta V_{i,m} = \begin{cases} -m \times r \times \Delta I_m & \text{for } m \le i \\ -i \times r \times \Delta I_m & \text{for } m > i \end{cases}, \quad \text{(EQN 3)}$$

where $\Delta V_{i,m}$ is the change in the supply voltage for the first pixel 103 at location i with respect to the change in the current ($\Delta I_m$) for the second pixel 103 at location m. The change in the current at a pixel with respect to a change in the supply voltage may be approximated by taking the derivative of EQN 1 with respect to $V_{DD}$. Using EQNS 1 and 3, the change in current for a first pixel 103 at location i due to a change in current for a second pixel 103 at location m can be expressed using the following equation:

$$\Delta I_{i,m}=-k[\Delta V_{i,m}\times(V_{DATA(i)}-V_{DD(i,m-1)}-V_{TH})+\Delta V_{i,m}^2], \quad \text{(EQN 4)}$$

where $\Delta I_{i,m}$ is the change in current for the first pixel 103 at location i due to the change in current ($\Delta I_m$) for the second pixel at location m, $\Delta V_{i,m}$ corresponds to EQN 3, and $V_{DD(i,m-1)}$ represents the voltage on the supply voltage line 109 seen by the pixel at location i right before the pixel at location m changes its current, with the IR drop being considered. Thus, EQN 4 provides an estimate of the change in current for a pixel 103 when the effects of IR drop and cross-talk are accounted for. As such, EQN 4, for example, may be used to identify the effects of IR drop and cross-talk on a pixel 103. In the situation where $\Delta V_{i,m}$ is small, EQN 4 may be approximated by:

$$\Delta I_{i,m}=-k\times(V_{DATA(i)}-V_{DD(i,m-1)}-V_{TH})\times\Delta V_{i,m}. \quad \text{(EQN 5)}$$

As will now be described, for each pixel 103, a compensated brightness signal may be applied to the data line 116 that results in the average actual current value provided by the driving transistor 206 being substantially the same as a target current. To begin, the following example assumes that the display device 100 has previously refreshed the pixels 103 using non-compensated brightness signals and that the display device 100 is prepared to initiate a pixel 103 refresh.

The display device 100 may identify a new target current value ($I_{target(m)}^{new}$) that is expected to result in the pixel 103 in the column emitting the desired light brightness. To this end, the display device 100 may, for example, query a look-up table having values stored therein, or the display device may calculate this value using, for example, an equation that models pixel 103 brightness as a function of the driving current.

The display device 100 may then identify the difference in current for the pixel 103 from when the pixel 103 was previously refreshed to the expected new target current value. This relationship may be expressed as:

$$\Delta I_{target(m)}=I_{target(m)}^{new}-I_{target(m)}^{old}. \quad \text{(EQN 6)}$$

Using EQN 3 with $\Delta I_{target(m)}$ being substituted for $\Delta I_m$, the change in the supply voltage seen by the pixel 103 may also be identified. For example, when m=i, as $\Delta V_{i,i}=-i\times r\times\Delta I_{target(i)}$, the change of current after refreshing may be obtained from EQN 5 with $\Delta I_{i,i}=-k\times(V_{DATA(i)}-V_{DD(i,i-1)}-V_{TH})\times\Delta V_{i,i}$, where $V_{DD(i,i-1)}$ is the power supply line 109 value seen by the pixel at location i before the refresh of that pixel. $V_{DD(i,i-1)}$ may be calculated using EQN 2 and substituting the actual power supply line value of every pixel in the column at that time or, in a continuously refreshing column, $V_{DD(i,i-1)}$ may be recorded and updated in a lookup table for every pixel. Thus, the change in the supply voltage and the change in the current for the pixel 103 due to the pixel 103 being refreshed may be identified.

The display device 100 may then identify the changes in the expected current value for the pixel 103 after each of the other pixels 103 in the column $C_1$-$C_y$ is refreshed. Thus, if there are y pixels 103 in the column $C_1$-$C_y$, there may be y changes in the expected current value that are identified. In order to calculate these changes, EQN 4 or EQN 5 may be used, for example. After the pixel at location i is refreshed, the circuit can continue to update the pixel at location i+1 after a time interval of $$\frac{1}{n\times f}$$

second, where f is the refresh rate of the screen. The $V_{DD}$ change on pixel i due to the update of pixel i+1 can be obtained by $\Delta V_{i,i+1}=-i\times r\times\Delta I_{target(i+1)}$ and the change in current of pixel i due to the refresh of pixel i+1 can be determined by $\Delta I_{i,i+1}=-k\times(V_{DATA(i)}-V_{DD(i,i)}-V_{TH})\times\Delta V_{i,i+1}$. As the pixels in the column keep refreshing, the updating continues through pixel n and pixel 1 until reaching the pixel at location i−1, which is the last pixel in this refresh cycle.

Upon identifying the change in the current when each of the other pixels 103 is refreshed, the display device 100 may identify the average of the current changes. This relationship may be determined as the average of the currents, for example, using the following equation:

$$I_{average(i)}=\frac{1}{n}\sum_{m=1}^{n}I_{i,m}=\frac{k}{n}\left[\sum_{m=1}^{i-1}m\Delta I_{i,i-m}+\sum_{m=1}^{n}m\Delta I_{i,i+n-m}+\frac{1}{2}(V_{DATA(i)}-V_{DD(i,i-1)}-V_{TH})^2\right]. \quad \text{(EQN 7)}$$

Next, the display device 100 identifies a value for the new brightness signal to be applied on the data line 116. Using EQN 7 and the following relationship, the value for $V_{DATA}$ for the pixel 103 can be identified by solving the following equations:

$$I_{target(i)}=I_{average(i)}. \quad \text{(EQN 8)}$$

Thus, a value for the brightness signal may be identified that takes into account the effects of the IR drop and cross-talk for a pixel 103. The identified value for $V_{DATA}$ can be applied to the data line 116 as a compensating brightness signal, and the pixel 103 can be refreshed. Over the cycle of refreshing all of the pixels 103 in the display device 100, the average current for the pixel 103 may be substantially the same as the target current that would result in the desired brightness of the pixel 103. Thus, a viewer may visually perceive the pixel 103 as being the desired brightness. Additionally, the other pixels 103 may be refreshed using a similar procedure as described above. Repeating the same steps for all pixels in the column will compensate the entire column of pixels for the IR drop.

The IR-drop and crosstalk compensation scheme thus operates by anticipation as follows: by looking ahead at upcoming data line signals it knows the desired brightness of each pixel. From that zeroth order data it estimates the IR drop occurring at each pixel due to the specific current drawn by the other pixels along the supply line. From that information a correction factor is calculated or provided, which once applied to the data signals compensates for the change in brightness due to that calculated IR drop. The scheme thus results in an average pixel brightness that approximates the desired brightness.

For demonstration, consider a 4-pixel 2T1C column of an AMOLED display such as that illustrated in FIG. 1 (i.e., y=4). Assume the voltage of the supply voltage line 109 is 10V, the threshold voltage of the driving transistor 206 (FIG. 2) is −2.4V, the areal capacitance (C) of the gate dielectric is 30 nF/cm$^2$, the mobility (μ) of the transistor is 5 cm$^2$/(V*s), and the transistor channel width to channel length ratio $$\left(\frac{W}{L}\right)$$

is 10, which gives:

$$k = \mu C\frac{W}{L} = 50\frac{\text{cm}^2}{\text{V}\times s}\times 30\frac{\text{nF}}{\text{cm}^2}\times 10 = 15\frac{\mu\text{A}}{V^2} \quad \text{(EQN 9)}$$

Based on a 634 μm×211 μm pixel size (e.g., the subpixel size for a 55", 16:9 aspect ratio and 1920×1080 resolution screen), a 600 cd/m$^2$ screen brightness, a 10 cd/A OLED efficiency and a 30% aperture ratio, the current supplied to each pixel can be calculated to be 8 μA. In order to illustrate a large IR drop on the supply voltage line 109 with the current of the four pixels, assume the resistance of the supply voltage line 109 between two adjacent pixels is 500Ω. While this may be unrealistically high compared with that of a real supply voltage line 109, the high resistance emphasizes the IR drop between pixels. From EQN 1, the $V_{DATA}$ can be determined to be 6.5672V from:

$$I = 8\ \mu\text{A} = \frac{1}{2}k(V_{DATA} - V_{DD} - V_{TH})^2 = \frac{1}{2}\times 15\frac{\mu\text{A}}{V^2}\times(V_{DATA} - 10\ \text{V} + 2.4\ \text{V})^2. \quad \text{(EQN 10)}$$

First, consider the uncompensated situation with $V_{DATA}$=6.5672 V applied to all four pixels. Due to the IR drop of the supply voltage line 109, the actual $V_{DD}$ voltage seen by each pixel will be different, resulting in different pixel currents. The IR drop on the supply voltage line 109 will reduce the current through pixel 1 almost 3%, while the current to pixel 4 is reduced by more than 7%. TABLE 1 provides examples of the different values due to the IR drop.

TABLE 1

| | $V_{DD}$ drop (V) | Actual $V_{DD}$ (V) | Actual pixel current (μA) | Deviation from target (%) | ΔI_target (μA) |
|---|---|---|---|---|---|
| pixel 1 | 0.0151383 | 9.9848617 | 7.7672646 | 2.910027474 | 0.2328042 |
| pixel 2 | 0.026393 | 9.973607 | 7.5964125 | 5.045660357 | 0.4036563 |
| pixel 3 | 0.0338495 | 9.9661505 | 7.4842656 | 6.447484552 | 0.5158032 |
| pixel 4 | 0.0375639 | 9.9624361 | 7.4287122 | 7.14189608 | 0.5713566 |

Now, consider the brightness compensation described above. Because the change of currents through pixels at a new refresh cycle is considered, an initial condition of currents is defined. A natural choice of initial currents is the uncompensated situation, so assume that the column of pixels was previously driven without any compensation. A new refreshing cycle starts from the refreshing of pixel 1. First of all $\Delta I_{target}$ can be calculated according to EQN 6 as the difference between the new target current, which is 8 μA and the previous current for each pixel. From the $\Delta I_{target}$, all $\Delta V_{i,i}$ values can be calculated based on EQN 3. $\Delta I_{i,m}$ may then be determined from EQN 5. Before doing that, it is beneficial to calculate all $V_{DD(i,m-1)}$ values, which can be based on EQN 2. With all the parameters, the expressions for $\Delta I_{average(i)}$ according to EQN 7 can be determined, and the appropriate $V_{DATA}$ for each pixel found by solving EQN 8. The average values are calculated based on the last refreshing cycle for each pixel. For all pixels, the deviation was found to be less than 0.05% as shown in TABLE 2.

There will be a finite difference between the target current value and the actual current value due to the approximation in the calculation process. After the signal is stabilized, this difference will not be further reduced since the target current value isn't changed. For example, pixel 3 will be carrying a current of 7.9972 μA as opposed to 8 μA, if the target current is kept at 8 μA for the subsequent refreshing cycles. In real world applications, this means that when displaying a static image where deviations may be more perceptible; there will be a finite error in the display that may not be corrected at this level of approximation. In this case, a more accurate solution considering more than one order of approximation or even an exact solution can be calculated to achieve a more accurate display. This is best done when the screen is displaying a static image because perceptual focus will make deviations more perceptible. In addition, the computational power resources can be allocated to do more accurate calculation. On the other hand, when the display is showing a motion picture, such as playing a movie, perceptual attention is distributed so a finite error in each single frame is less likely to be perceived, which should make the first order approximation adequate. If less error is needed and computational resource is available, then second or higher orders of calculation may be applied for the motion picture display as well.

TABLE 2

| | pixel 1 | pixel 2 | pixel 3 | pixel 4 |
|---|---|---|---|---|
| VDATA (V) | 6.5516 | 6.5396 | 6.5314 | 6.5272 |
| pixel current after line 1 refreshing (μA) | 8.0054 | 7.5947 | 7.4826 | 7.427 |
| pixel current after line 2 refreshing (μA) | 8.0023 | 8.0108 | 7.4766 | 7.4212 |
| pixel current after line 3 refreshing (μA) | 7.994 | 7.9941 | 7.9972 | 8 |
| pixel current after line 4 refreshing (μA) | 7.994 | 7.9941 | 7.9972 | 8 |
| pixel current after line 5 refreshing (μA) | | 7.9941 | 7.9972 | 8 |
| pixel current after line 6 refreshing (μA) | | | 7.9972 | 8 |
| pixel current after line 7 refreshing (μA) | | | | 8 |
| pixel current average for the cycle (μA) | 7.998925 | 7.998275 | 7.9972 | 8 |
| deviation from target (%) | 0.0134375 | 0.0215625 | 0.035 | 0 |

Figure 3:
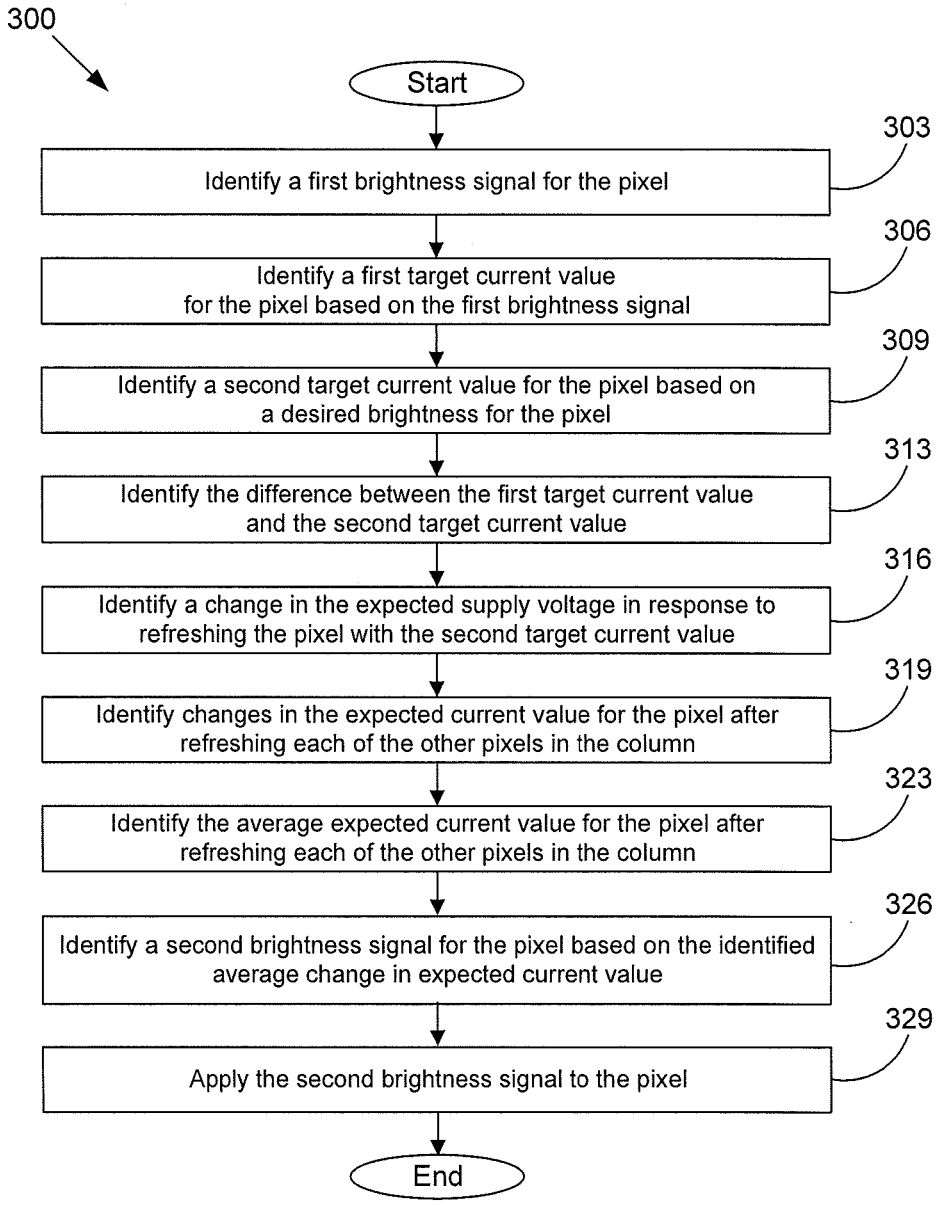
FIG. 3 is a flowchart illustrating an example of functionality implemented by a controller in the display device of FIG. 1 according to various embodiments of the present disclosure.

Referring next to FIG. 3, shown is a flowchart illustrating an example of functionality implemented by a brightness controller 300 (FIG. 4) in the display device 100 (FIG. 1) according to various embodiments of the present disclosure. The brightness controller 300 may comprise, for example, a processing device and/or logic executable in a processing device. It is understood that the flowchart of FIG. 3 provides merely an example of the many different types of functional arrangements that may be employed to implement the operation of the portion of the brightness controller 300 as described herein. As an alternative, the flowchart of FIG. 3 may be viewed as depicting an example of steps of a method implemented in the display device 100 according to one or more embodiments.

Beginning with box 303, the brightness controller 300 identifies a first brightness signal for the pixel 103. The first brightness signal may be, for example, the value for a non-compensated brightness signal previously used to refresh the pixel 103. Next, as shown in box 306, a first target current value is identified for the pixel 103 based at least in part on the first brightness signal identified in box 303. The brightness controller 300 then moves to box 309 and identifies a second target current value for the pixel 103 based at least in part on a desired brightness for the pixel 103. To this end, the brightness controller 300 may query a lookup table or calculate the second target current value, for example. Moving to box 313, the brightness controller 300 identifies the difference between the first target current value and the second target current value. This relationship is represented by EQN 6 above.

As shown in box 316, the brightness controller 300 then identifies a change in the expected supply voltage for the pixel 103 in response to the pixel 103 being refreshed with the second target current value. The brightness controller 300 then moves to box 319 and identifies changes in the expected current value for the pixel 103 due to each one of the other pixels 103 in the column $C_1$-$C_y$ being refreshed. To this end, the brightness controller 300 may, for example, apply EQN 4 or EQN 5 above. Next, as shown in box 323, the average expected current value for the pixel 103 after refreshing each of the other pixels 103 in the column $C_1$-$C_y$ is identified. The brightness controller 300 may, for example, apply EQN 7 above in order to identify the average expected current values and express them as functions of the second brightness signals, such as $V_{DATA}$ for each pixel 103 in the column.

In box 326, the brightness controller 300 identifies a second brightness signal for the pixel 103 based at least in part on the identified average change for the expected current value, which was identified in box 323. To this end, EQN 8 may be employed in order to calculate the brightness signal such as $V_{DATA}$. In box 329, the brightness controller 300 applies the second brightness signal on the data line 116 for the pixel 103. Thereafter the process ends. The functionality implemented by the brightness controller 300 (FIG. 4) in the display device 100 (FIG. 1) does not rely on a particular pixel circuit design to work, so it can be used in a variety of circuit designs where the IR drop will have an impact on a column of pixels, while the interactions between pixels due to the IR drop can be calculated. It can work in both voltage programmed and current programmed pixel circuits. It will work for TFT backplanes or other transistor enabled backplanes, such as a carbon nanotube enabled vertical organic light emitting transistor (CN-VOLET) backplane.

Figure 4:
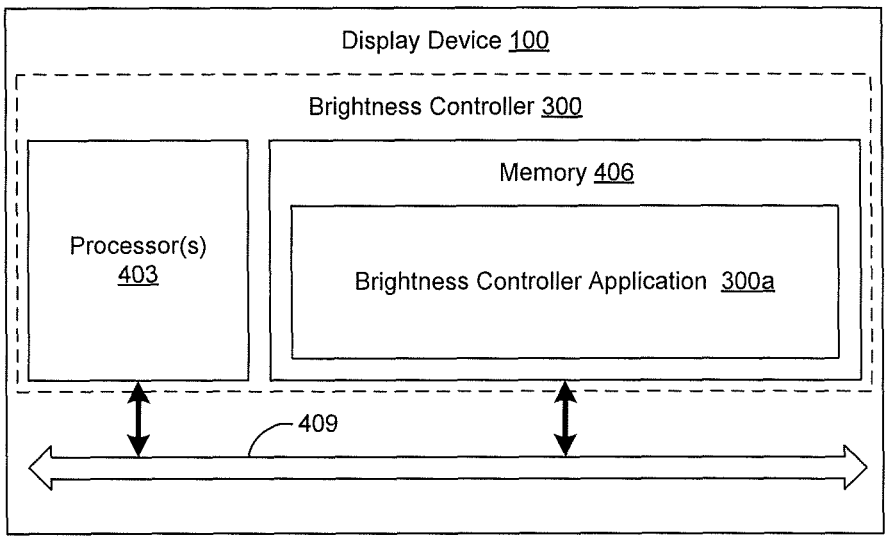
FIG. 4 is a schematic block diagram of an example of the display device of FIG. 1 according to various embodiments of the present disclosure.

Turning to FIG. 4, shown is a schematic block diagram of an example of the display device 100 according to various embodiments of the present disclosure. The display device 100 includes at least one processor circuit, for example, having a processor 403 and a memory 406, both of which are coupled to a local interface 409. The local interface 409 may comprise, for example, a data bus with an accompanying address/control bus or other bus structure as can be appreciated.

Stored in the memory 406 are both data and several components that are executable by the processor 403. In particular, stored in the memory 406 and executable by the processor 403 may be a brightness controller application 300*a*, and potentially other applications. Where any component discussed herein is implemented in the form of software, any one of a number of programming languages may be employed such as, for example, C, C++, C#, Objective C, Java, Javascript, Perl, PHP, Visual Basic, Python, Ruby, Delphi, Flash, or other programming languages.

A number of software components may be stored in the memory 406 and executable by the processor 403. In this respect, the term "executable" means a program file that is in a form that can ultimately be run by the processor 403. Examples of executable programs may be, for example, a compiled program that can be translated into machine code in a format that can be loaded into a random access portion of the memory 406 and run by the processor 403, source code that may be expressed in proper format such as object code that is capable of being loaded into a random access portion of the memory 406 and executed by the processor 403, or source code that may be interpreted by another executable program to generate instructions in a random access portion of the memory 406 to be executed by the processor 403, etc. An executable program may be stored in any portion or component of the memory 406 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 406 is defined herein as including both volatile and nonvolatile memory and data storage components. Volatile components are those that do not retain data values upon loss of power. Nonvolatile components are those that retain data upon a loss of power. Thus, the memory 406 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 403 may represent multiple processors 403, and the memory 406 may represent multiple memories 406 that operate in parallel processing circuits, respectively. In such a case, the local interface 409 may be an appropriate network that facilitates communication between any two of the multiple processors 403, between any processor 403 and any of the memories 406, or between any two of the memories 406, etc. The local interface 409 may comprise additional systems designed to coordinate this communication, including, for example, performing load balancing. The processor 403 may be of electrical or of some other available construction.

Although the brightness controller 300, and other various systems described herein, may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowchart of FIG. 3 shows an example of the functionality and operation of an implementation of portions of the brightness controller 300. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 403 in a computer system or other system. The machine code may be converted from the source code, etc. If embodied in hardware, each block may represent a circuit or a number of interconnected circuits to implement the specified logical function(s).

Although the flowchart of FIG. 3 shows a specific order of execution, it is understood that the order of execution may differ from that which is depicted. For example, the order of execution of two or more blocks may be scrambled relative to the order shown. Also, two or more blocks shown in succession in FIG. 3 may be executed concurrently or with partial concurrence. Further, in some embodiments, one or more of the blocks shown in FIG. 3 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the brightness controller application 300*a*, that comprises software or code can be embodied in any non-transitory computer-readable medium for use by or in connection with an instruction execution system such as, for example, a processor 403 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

Embodiments of the present disclosure include, but are not limited to, a method comprising identifying, in a display device, an IR voltage drop effect on a pixel in the display device based at least in part on a plurality of currents drawn by a plurality of other pixels being supplied by a same supply voltage line and generating, in the display device, a brightness signal for the pixel based at least in part on the IR voltage drop effect, wherein the brightness signal compensates for the IR voltage drop effect. Another embodiment includes a method comprising calculating, in a display device, values of the IR voltage drop for each pixel due to the specific currents to be drawn by all the pixels fed by the same supply voltage line, necessary to display the next specific frame of the scene at the requisite pixel brightness appropriate to the scene and providing a data line signal to each pixel that compensates for the IR voltage drop based upon that calculation and thereby ensuring the requisite perceived pixel brightness appropriate to the specific frame of the scene.

The brightness signal may be based at least in part on an average of a plurality of current values for the pixel in response to a plurality of other pixels being refreshed. The brightness signal may be a voltage and/or a current. The pixel(s) may comprise an organic light emitting diode (OLED). The display device may comprise an active matrix organic light emitting diode (AMOLED) panel. The pixel may comprise a vertical light emitting transistor. The pixel may comprise an active matrix light emitting transistor panel. The instantaneous brightness of a specific pixel may change as other pixels sharing the supply voltage line are refreshed, while the average perceived brightness of the specific pixel, which was set by the data line signal, based upon the calculation, is appropriate for the specific frame of the scene.

It is emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. For instance, aspects of the present disclosure can be used for other pixel architecture implementations. For example, aspects of the present disclosure may be used for an active matrix display that uses an integrated drive transistor and light emitter, such as that described in U.S. Pat. No. 8,232,561, entitled "NANOTUBE ENABLED, GATE-VOLTAGE CONTROLLED LIGHT EMITTING DIODES," filed on Sep. 10, 2008, and WIPO Publication WO/2012/078759, entitled "ACTIVE MATRIX DILUTE SOURCE ENABLED VERTICAL ORGANIC LIGHT EMITTING TRANSISTOR," filed on Jul. 12, 2011, both of which are incorporated by reference herein in their entireties, or any alternative pixel design subject to IR drops and cross-talk. All such modifications and variations are intended to be included herein.

Therefore, at least the following is claimed:

1. A method, comprising:

estimating, for a display device, an IR voltage drop effect on one pixel of a plurality of pixels supplied by a supply voltage line in the display device, wherein the estimating comprises:

calculating, for the one pixel, a plurality of current values associated with currents drawn by refreshing the other pixels of the plurality of pixels supplied by the supply voltage line, wherein each of the plurality of current values corresponds to current for the one pixel during refreshing a pixel of the other pixels; and estimating the IR voltage drop effect on the one pixel based on the plurality of current values; and generating a brightness signal for the one pixel of the plurality of pixels based at least in part on the estimated IR voltage drop effect, wherein the brightness signal compensates for the IR voltage drop effect on the one pixel of the plurality of pixels.

2. The method of claim 1, wherein estimating the IR voltage drop effect on the one pixel further comprises averaging the plurality of current values.

3. The method of claim 1, wherein the one pixel of the plurality of pixels comprises an organic light emitting diode (OLED).

4. The method of claim 1, wherein the display device comprises an active matrix organic light emitting diode (AMOLED) panel.

5. The method of claim 1, wherein the one pixel of the plurality of pixels comprises a carbon nanotube enabled vertical organic light emitting transistor (CN-VOLET).

6. The method of claim 1, wherein estimating the IR voltage drop effect further comprises estimating the IR voltage drop effect for the one pixel of the plurality of pixels due to current drawn by the other pixels of the plurality of pixels associated with an upcoming data line signal.

7. The method of claim 1, wherein the brightness signal is a voltage.

8. The method of claim 1, wherein the brightness signal is a current.

9. The method of claim 1, wherein the plurality of pixels are in a column of a matrix of pixels in the display device.

10. A method for driving an active matrix display, comprising the steps of:

predicting, for a display device, values of IR voltage drop corresponding to a plurality of pixels fed by a common supply voltage line, wherein the predicting comprises:

calculating, for each pixel of the plurality of pixels, values of IR voltage drop due to currents drawn by refreshing each of the other pixels of the plurality of pixels to display a frame, wherein individual values of the IR voltage drop correspond to an IR voltage drop effect experienced by one pixel during refreshing one of the other pixels; and estimating a brightness signal for each pixel of the plurality of pixels based on the values of the IR voltage drop and brightness corresponding to display of the frame; and providing a data line signal to each of the plurality of pixels that compensates for the IR voltage drop, wherein the data line signal includes the brightness signal for each pixel of the plurality of pixels.

11. The method of claim 1, wherein calculating the plurality of current values for the one pixel further comprises calculating each of the plurality of current values based on a change in current for the one pixel during refreshing a pixel of the other pixels.

12. The method of claim 10, wherein an instantaneous brightness of a specific pixel of the plurality of pixels changes as other pixels of the plurality of pixels are refreshed.

13. The method of claim 12, wherein the pixel brightness is an average pixel brightness of a defined time interval based upon the changes in the instantaneous brightness as each of the other pixels are refreshed.

14. The method of claim 10, wherein the plurality of pixels is in a column of a matrix of pixels, and calculating the values of IR voltage drop is based on currents drawn by each of the other pixels in the column during a refresh cycle.

15. The method of claim 10, wherein the frame is a next frame of a series of frames.

16. A display device, comprising:

a matrix of pixels comprising lines of pixels that are supplied by a common supply voltage line; and a brightness controller configured to:

estimate, for the display device, an IR voltage drop effect on a pixel of one line of the lines of pixels, wherein the estimating comprises:

calculating, for the pixel, a plurality of current values associated with currents drawn by other pixels of the one line during a refresh cycle of the other pixels of the line, wherein each of the plurality of current values corresponds to current for the pixel during refreshing one of the other pixels; and averaging the plurality of current values for the pixel to determine an average pixel brightness associated with the pixel; and generate a brightness signal for the pixel based at least in part on the average pixel brightness associated with the pixel.

17. The display device of claim 16, comprising an active matrix organic light emitting diode (AMOLED) panel including the matrix of pixels.

18. The display device of claim 16, wherein the lines of pixels are columns of the matrix of pixels.

19. The display device of claim 16, wherein the pixel comprises a carbon nanotube enabled vertical organic light emitting transistor (CN-VOLET).

20. The display device of claim 16, wherein the pixel comprises a driving transistor configured to control an amount of current that flows through a light emitting device based at least in part upon the brightness signal.

21. The display device of claim 16, wherein the brightness controller comprises an application executable by processing circuitry of the display.

* * * * *